US010510202B2

(12) United States Patent
Machida et al.

(10) Patent No.: US 10,510,202 B2
(45) Date of Patent: Dec. 17, 2019

(54) COIN IDENTIFICATION DEVICE

(71) Applicant: FUJI ELECTRIC CO., LTD., Kawasaki-shi, Kanagawa (JP)

(72) Inventors: Kazutoshi Machida, Yokkaichi (JP); Takamasa Asano, Hino (JP); Yu Taniguchi, Hachioji (JP); Yoshihiro Nakamura, Yokkaichi (JP); Nobuyuki Niizuma, Yokkaichi (JP); Shuhei Saito, Kawagoe (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 158 days.

(21) Appl. No.: 15/790,560

(22) Filed: Oct. 23, 2017

(65) Prior Publication Data

US 2018/0151016 A1 May 31, 2018

(30) Foreign Application Priority Data

Nov. 30, 2016 (JP) ..... 2016-232172

(51) Int. Cl.
*G07D 5/02* (2006.01)
*G07D 5/08* (2006.01)

(52) U.S. Cl.
CPC ..... *G07D 5/08* (2013.01); *G07D 5/02* (2013.01)

(58) Field of Classification Search
CPC ... G07D 5/02; G07D 5/08; G07D 5/10; B60Q 2300/126; G01R 27/2605; G01R 33/123; G01R 33/14; H01F 27/027; H01F 27/30; H01F 27/32; H01F 27/06; H01F 27/26; H01F 27/292; H01F 27/322; H01F 27/323; H01F 27/263; H01F 27/266; H01F 27/324; H01F 2027/065; H01F 17/043; H01F 17/045; F15B 2211/8646; F15B 61/10
USPC ..... 194/302, 303, 317–320; 453/7, 11, 56; 336/65, 83, 185, 210; 324/222, 662, 669
See application file for complete search history.

(56) References Cited

U.S. PATENT DOCUMENTS 3,463,171 A * 8/1969 Dolman ..... G07D 9/008 198/431
3,576,244 A * 4/1971 Ptacek ..... G07D 5/08 194/318
6,398,001 B1 6/2002 Hutchinson et al.
6,640,955 B1 * 11/2003 Furuya ..... G07D 5/005 194/317

(Continued)

FOREIGN PATENT DOCUMENTS

JP 2001-513232 8/2001

*Primary Examiner* — Jeffrey A Shapiro

(57) ABSTRACT

A coin identification device includes: a first magnetic sensor detecting an amount of magnetic variation while the coin passes in the carrying direction; a second magnetic sensor installed where the second magnetic sensor detects a passage of an arc of a small-diameter coin when the first magnetic sensor detects a passage of the small-diameter coin; and a third magnetic sensor installed where the third magnetic sensor does not detect a passage of an arc of the small-diameter coin when the first magnetic sensor and the second magnetic sensor detect a passage of the small-diameter coin and detects a passage of an arc of a large-diameter coin; and an identification control unit identifying an outer diameter of the small-diameter coin and the large-diameter coin based on the amount of magnetic variation of the first magnetic sensor.

20 Claims, 14 Drawing Sheets

(56) References Cited

U.S. PATENT DOCUMENTS

| | | | | |
|---|---|---|---|---|
| 2003/0102197 | A1* | 6/2003 | Furuya | G07D 5/005 194/318 |
| 2003/0150688 | A1* | 8/2003 | Martin | G07D 3/06 194/317 |
| 2004/0084278 | A1* | 5/2004 | Harris | G07D 5/00 194/302 |
| 2014/0144751 | A1* | 5/2014 | Bilas | G07F 1/06 194/214 |
| 2014/0295204 | A1* | 10/2014 | Li | A44C 21/00 428/596 |
| 2016/0171809 | A1* | 6/2016 | Ohtomo | G07D 5/02 194/317 |

* cited by examiner

COIN IDENTIFICATION DEVICE

CROSS-REFERENCE TO RELATED APPLICATION(S)

The present application claims priority to and incorporates by reference the entire contents of Japanese Patent Application No. 2016-232172 filed in Japan on Nov. 30, 2016.

BACKGROUND

The present disclosure relates to a coin identification device.

In the related art, an automatic vending machine, an automatic change machine and the like includes a coin identification device that includes a magnetic detecting unit, which is installed near a coin pathway through which a coin passes, that identifies the coin passing through the coin pathway.

For example, a material sensor and an outer diameter sensor as the magnetic detecting unit are sequentially disposed near the coin pathway and along the passing direction of the coins. The material sensor detects the material of the coins passing through the coin pathway. The outer diameter sensor detects the outer diameter of the coins passing through the coin pathway. In a coin identification device including such a magnetic detecting unit, the width of the outer diameter sensor is set to be sufficiently greater than the outer diameters of all coins that are likely to pass through the coin pathway, thereby allowing changes in the relative positional relationship between the outer diameter sensor and the coins due to foreign particles attached to the edges of the coins. Thus, the outer diameters of the coins can be detected accurately (see Japanese National Publication of International Patent Application No. 2001-513232).

SUMMARY

According to an embodiment of the present disclosure, a coin identification device that identifies denomination of a coin inserted therein, include: a first magnetic sensor that includes a coil which is wound in an elliptical shape in a manner that a long axis of the coil extends in a carrying direction of the coin wherein a maximum diameter of the coil is smaller than a maximum diameter of the coin, and that continuously detects an amount of magnetic variation while the coin passes in the carrying direction; a second magnetic sensor that is installed in the direction of the long axis and at a position where the second magnetic sensor detects a passage of an arc of a small-diameter coin when the first magnetic sensor is detecting a passage of the small-diameter coin having a diameter equal to or smaller than a predetermined diameter; and a third magnetic sensor that is installed at a position where the third magnetic sensor does not detect a passage of an arc of the small-diameter coin having a diameter equal to or smaller than a predetermined diameter when the first magnetic sensor and the second magnetic sensor are detecting a passage of the small-diameter coin and the third magnetic sensor detects a passage of an arc of a large-diameter coin having a diameter exceeding a predetermined diameter; and an identification control unit identifying an outer diameter of the small-diameter coin based on the amount of magnetic variation of the first magnetic sensor when the first magnetic sensor detects the coin, the second magnetic sensor detects a passage of an arc of the coin, and the third magnetic sensor does not detect a passage of an arc of the coin, and further identifying an outer diameter of the large-diameter coin based on the amount of the magnetic variation of the first magnetic sensor when the first magnetic sensor and the second magnetic sensor detect the coin and the third magnetic sensor detects an passage of an arc of the coin.

DETAILED DESCRIPTION

In the coin identification device disclosed in Japanese National Publication of International Patent Application No. 2001-513232, in order to allow changes in the relative positional relationship between the outer diameter sensor and the coins, the changes being caused by foreign particles attached to the edges of the coins, the width of the outer diameter sensor is set to be greater than all coins that may pass through the coin pathway. However, the entire size of the device may become greater as a result. Moreover, the size of the device may become greater because it is necessary to dispose a sensor to reduce a mutual magnetic interference between the outer diameter sensor and the other sensors such as a material sensor.

Therefore, there is a need for to at least partially solve the problems in the related technology.

Exemplary embodiments of the present invention are described below with reference to the accompanying drawings.

First Embodiment

Overall Configuration of Coin Identification Device

Figure 1:
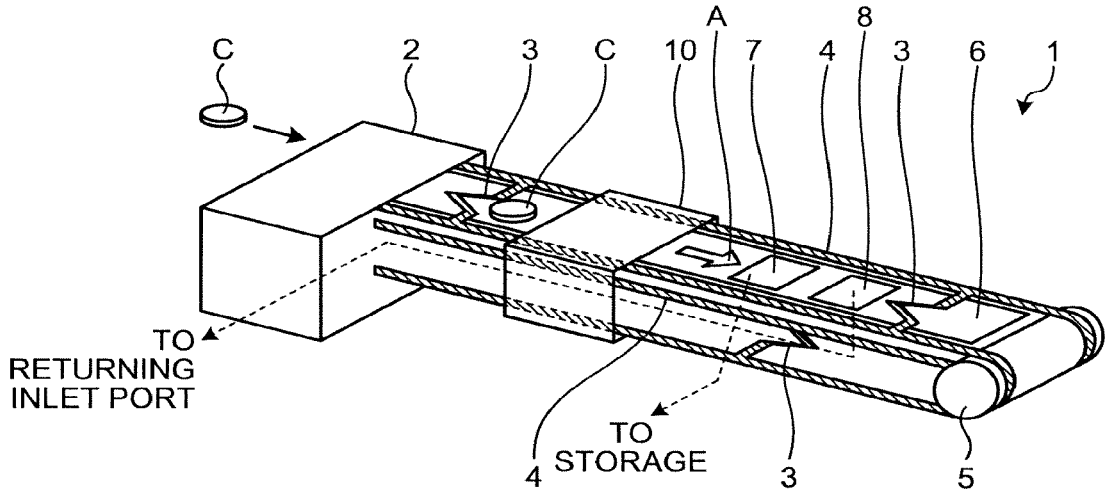
FIG. 1 is a schematic diagram illustrating a perspective view of a brief configuration of a coin identification device according to a first embodiment of the present disclosure.

FIG. 1 is a schematic diagram illustrating a perspective view of a brief configuration of a coin identification device 1 according to a first embodiment of the present disclosure. The coin identification device 1 illustrated in FIG. 1 is implemented in an automatic change machine. As illustrated in FIG. 1, the coin identification device 1 includes a hopper 2 that temporarily holds an inserted coin C before sending out the coin C; carrier belts 4 that carry the coins, which have been sent out by the hopper 2, in a carrying direction A; and a coin identification unit 10 that identifies the denomination of the coins that have been carried by the carrier belts 4.

On a carrying pathway 6, a specie discharger 7 and a coin returning inlet 8 are provided in this order on the downstream side of the coin identification unit 10. When the denomination of the coin can be identified, the coin identification unit 10 opens the specie discharger 7 and delivers that coin to a storage (not illustrated). On the other hand, if the denomination of the coin cannot be identified, the coin identification unit 10 opens the coin returning inlet 8 and delivers that coin to a returning inlet port (not illustrated).

The carrier belts 4 refer to a pair of toothed belts and are driven around a pulley 5. In between the pair of carrier belts 4, coin positioning members 3 are intermittently arranged along the carrying direction A. The coin positioning members 3 serve as a center-positioning and carrying mechanism that draws out the coin C from the hopper 2 and uniaxially carrying the center of the coin C along the carrying direction A regardless of the outer diameter of the denominations. The coins that are returned via the coin returning inlet 8 are carried to the hopper 2 by the coin positioning members 3 disposed in the returning direction from the pulley 5, and are discharged to the returning inlet port (not illustrated).

Figure 2:
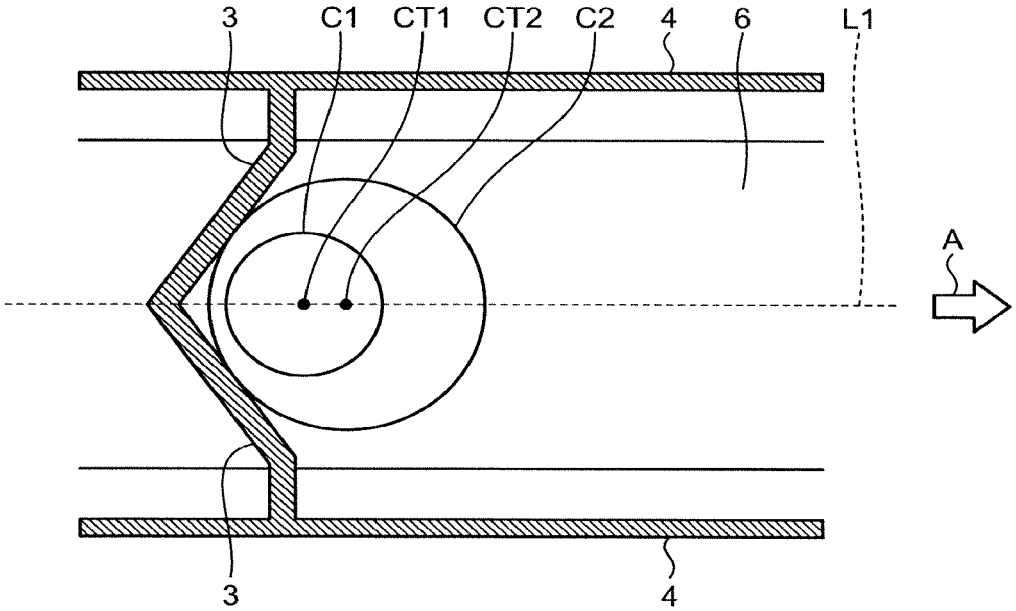
FIG. 2 is a diagram explaining the coin positioning done by a coin positioning member.

FIG. 2 is a diagram explaining the coin positioning done by the coin positioning member 3. As illustrated in FIG. 2, the coin positioning member 3 has a tapering shape with the center thereof in the width direction being orthogonal to the carrying direction A, thereby forming a depression with respect to the carrying direction A; and, while pressing the coins toward the carrying direction A, regulates the movement in a manner that the center of all coins moves along a center line L1 of the carrying direction A. By doing this, for example, as illustrated in FIG. 2, a center CT1 of a small-diameter coin C1 having a small outer diameter as well as a center CT2 of a large-diameter coin C2 having a large outer diameter moves along the center line L1.

Configuration of Coin Identification Unit

Figure 3:
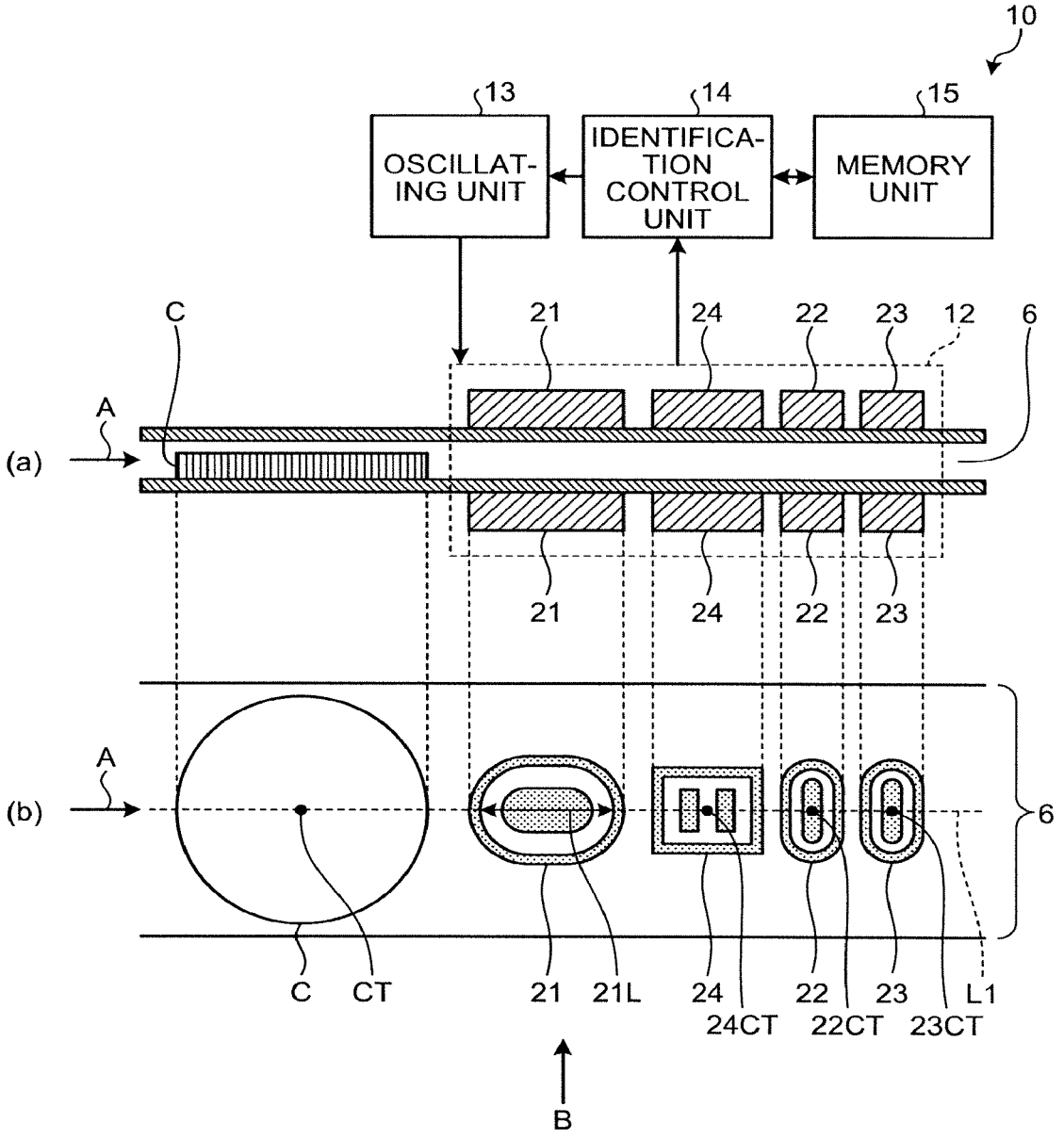
FIG. 3 is a diagram illustrating a configuration of a coin identification unit.

FIG. 3 is a diagram illustrating a configuration of the coin identification unit 10. Part (b) of FIG. 3 is a planar view that schematically illustrates the coin identification unit 10, and part (a) of FIG. 3 is a B-arrow perspective view that schematically illustrates the coin identification unit 10 illustrated in part (b) of FIG. 3. Meanwhile, in part (a) of FIG. 3, the relation of connection of the control system of the coin identification unit 10 is also illustrated. As illustrated in FIG. 3, the coin identification unit 10 includes a sensor unit 12 in which a first magnetic sensor 21, a fourth magnetic sensor 24, a second magnetic sensor 22, and a third magnetic sensor 23 are arranged in this order from the upstream side of the carrying direction A. The first magnetic sensor 21 to the fourth magnetic sensor 24 are individually made of a pair of coils that are arranged opposite to each other on both sides of the carrying pathway 6.

Under the control of an identification control unit 14, an oscillating unit 13 supplies alternating-current signals causing excitement of the magnetic sensors (the first magnetic sensor 21 to the fourth magnetic sensor 24) in the sensor unit 12. The identification control unit 14 identifies the denomination of the coin C based on the detection results of the magnetic sensors in the sensor unit 12. A memory unit 15 is used to store the detection results of the magnetic sensors in the sensor unit 12, and the stored content is used in control operations performed by the identification control unit 14.

In the first magnetic sensor 21, the coils are wound in an elliptical shape with the carrying direction A of carrying the coin C representing the direction of the long axis, and the maximum diameter of the coils is smaller than the maximum diameter of coins. The first magnetic sensor 21 continuously detects the amount of magnetic variation while the coin C passes along the carrying direction A. The first magnetic sensor 21 has a track-like shape in which two circles having equal radii are joined by an external common tangent. This oval track-like shape is included in the elliptical shape. A long axis 21L of the first magnetic sensor 21 is placed to be coincident to the center line L1, and thus the shape of the first magnetic sensor 21 has a high sensitivity for the carrying direction A.

In the second magnetic sensor 22 and the third magnetic sensor 23, the coils are wound in an elliptical shape with the width direction orthogonal to the carrying direction A of carrying the coin C representing the direction of the long axis, and the maximum diameter of the coils is smaller than the maximum diameter of the coin C. Moreover, a center 22CT of the second magnetic sensor 22 and a center 23CT of the third magnetic sensor 23 are placed to be coincident with the center line L1. The long axis of the second magnetic sensor 22 and the third magnetic sensor 23 has the length substantially equal to the short axis of the first magnetic sensor 21. Meanwhile, the second magnetic sensor 22 and the third magnetic sensor 23 may not have an elliptical shape, and may have a circular shape. Herein, the second magnetic sensor 22 and the third magnetic sensor 23 detect the passage of at least an arc of the coin C.

The fourth magnetic sensor 24 is installed in between the first magnetic sensor 21 and the second magnetic sensor 22, and detects the surface asperity of coins.

Figure 4:
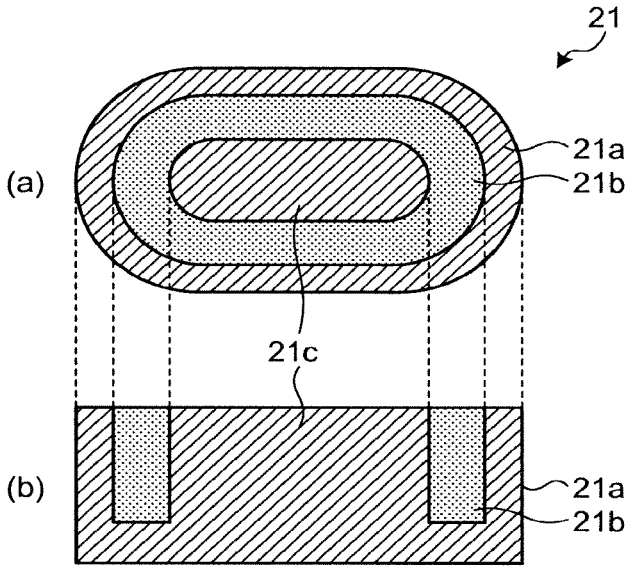
FIG. 4 is a diagram illustrating a configuration of a first magnetic sensor.
Figure 5:
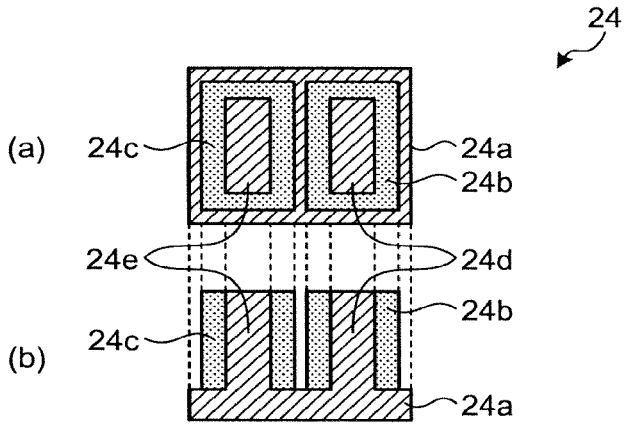
FIG. 5 is a diagram illustrating a configuration of a fourth magnetic sensor.

Meanwhile, as illustrated in FIG. 4, in the first magnetic sensor 21, a coil 21*b* is annularly wound around a rod portion 21*c* of an elliptical pot-core that is formed using sintered ferrite. The same is the case regarding the second magnetic sensor 22 and the third magnetic sensor 23. In contrast, as illustrated in FIG. 5, in the fourth magnetic sensor 24, coils 24*b* and 24*c* are wound around rod portions 24*d* and 24*e*, respectively, of a u-shaped pot-core 24*a* that is formed using sintered ferrite.

Figure 6:
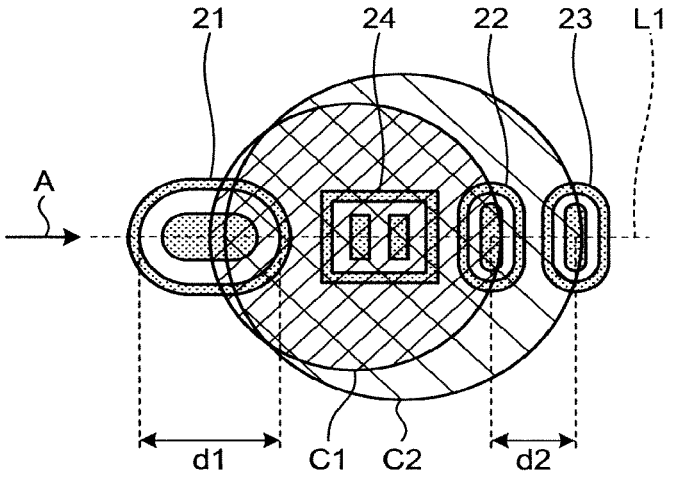
FIG. 6 is a diagram illustrating relative positional relationships between first to fourth magnetic sensors according to the first embodiment and a small-diameter coin and a large-diameter coin.

As illustrated in FIG. 6, the second magnetic sensor 22 is installed at a position at which, when the arc of a small-diameter coin C1 having the diameter equal to or smaller than a predetermined diameter is detected in the middle of the direction of the long axis of the first magnetic sensor 21, the arc on the opposite side with respect to the carrying direction A of the small-diameter coin C1 is detected. Moreover, the third magnetic sensor 23 is placed at a position at which, when the arc of a large-diameter coin C2 having the diameter exceeding the predetermined diameter is detected in the middle of the direction of the long axis of the first magnetic sensor 21, the arc on the opposite side with respect to the carrying direction A of the large-diameter coin C2 is detected. Thus, when the arc of a coin is detected in the middle of the direction of the long axis of the first magnetic sensor 21, if that coin is a small-diameter coin C1, the second magnetic sensor 22 detects the arc of the coin and the third magnetic sensor 23 does not detect the arc of the coin. However, when the arc of a coin is detected in the middle of the direction of the long axis of the first magnetic sensor 21, if that coin is a large-diameter coin C2, the second magnetic sensor 22 has already detected the arc of the coin and the third magnetic sensor 23 detects the arc of the coin. Herein, as far as the Japanese coins are concerned, the predetermined diameter is set to, for example, 25 mm that is in between 26.5 mm representing the outer diameter of a 500-yen coin and 23.5 mm representing the outer diameter a 10-yen coin having the second largest outer diameter. As described above, regarding the second magnetic sensor 22 and the third magnetic sensor 23, the coils are wound in an elliptical shape with the width direction orthogonal to the carrying direction A for carrying the coin C representing the direction of the long axis. Hence, the passage of the arc of the coin C can be detected with accuracy.

Regarding the discrimination of the outer diameters of coins, when the second magnetic sensor 22 detects the arc of a coin, as long as the first magnetic sensor 21 is able to detect the amount of magnetic variation corresponding to various small-diameter coins C1, it serves the purpose. Moreover, regarding the discrimination of the outer diameters of coins, when the third magnetic sensor 23 detects the arc of a coin, as long as the first magnetic sensor 21 is able to detect the amount of magnetic variation corresponding to various large-diameter coins C2, it serves the purpose. For that reason, the coils of the first magnetic sensor 21 are elliptical in shape and have the long axis running along the carrying direction A. In other words, when the second magnetic sensor 22 detects the arc of a coin, if the first magnetic sensor 21 can detect a sufficient amount of magnetic variation, then the coin is a small-diameter coin C1. Similarly, when the third magnetic sensor 23 detects the arc of a coin, if the first magnetic sensor 21 can detect a sufficient amount of magnetic variation, then the coin is a large-diameter coin C2.

Figure 7:
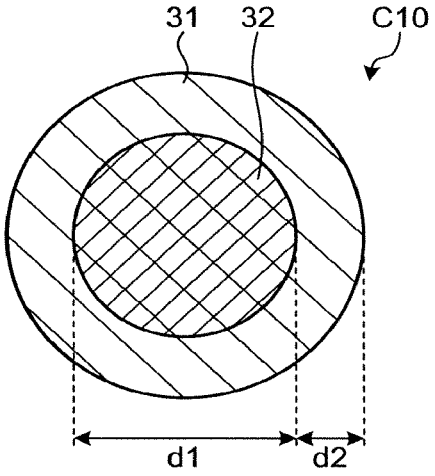
FIG. 7 is a diagram illustrating a configuration of a bicolor coin.

Meanwhile, herein, coins not only imply single-material coins but also imply bicolor coins such as a bicolor coin C10 that, as illustrated in FIG. 7, includes an outer ring portion 31 and includes a disk-shaped core portion 32 that is embedded in the hollow area of the outer ring portion 31. In the first embodiment, the bicolor coin C10 is also treated as the identification target. Hence, it is desirable that the length of the long axis of the first magnetic sensor 21 be set to correspond to a diameter d1 of the core portion 32. That is, it is desirable that the length of the long axis of the first magnetic sensor 21 be set to exceed the diameter d1 of the core portion 32.

Moreover, it is desirable that the distance between the second magnetic sensor 22 and the third magnetic sensor 23 in the carrying direction A be set to correspond to a width d2 of the outer ring portion 31 of the bicolor coin C10.

Figure 8:
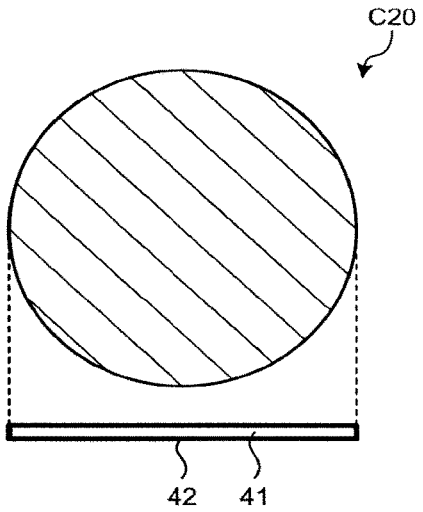
FIG. 8 is a diagram illustrating a configuration of a clad coin.

Moreover, coins also imply coins such as a clad coin C20 in which a surface layer 42 and a middle layer 41 are made of different materials as illustrated in FIG. 8. In the first embodiment, the clad coin C20 is also treated as the identification target. For that reason, the second magnetic sensor 22 and the third magnetic sensor 23 are set to have oscillation frequencies different from each other. For example, the excitation of the second magnetic sensor 22 is set at a high frequency of 80 kHz, and the excitation of the third magnetic sensor 23 is set at a low frequency of 20 kHz.

That is because, using the characteristics that the low-frequency magnetic field penetrates to the inside of a coin and the high-frequency magnetic field penetrates only to the surface of the coin, the second magnetic sensor 22 having a high frequency is made to detect the material of the surface layer 42 and the third magnetic sensor 23 having a low frequency is made to detect the material of the middle layer 41.

Specific Example of Coin Identification

FIGS. 9 to 12 are timing charts illustrating specific examples of the coin identification performed on a 1-yen coin serving as the small-diameter coin, a 500-yen coin serving as the large-diameter coin, a large-diameter coin similar to a 500-yen coin, and a large-diameter bicolor coin. In FIGS. 9 to 12, characteristics L11, L21, L31, and L41 indicate time variations of the first magnetic sensor 21; L12, L22, L32, and L42 indicate time variations of the second magnetic sensor 22; and L13, L23, L33, and L43 indicate time variations of the third magnetic sensor 23.

Figure 9:
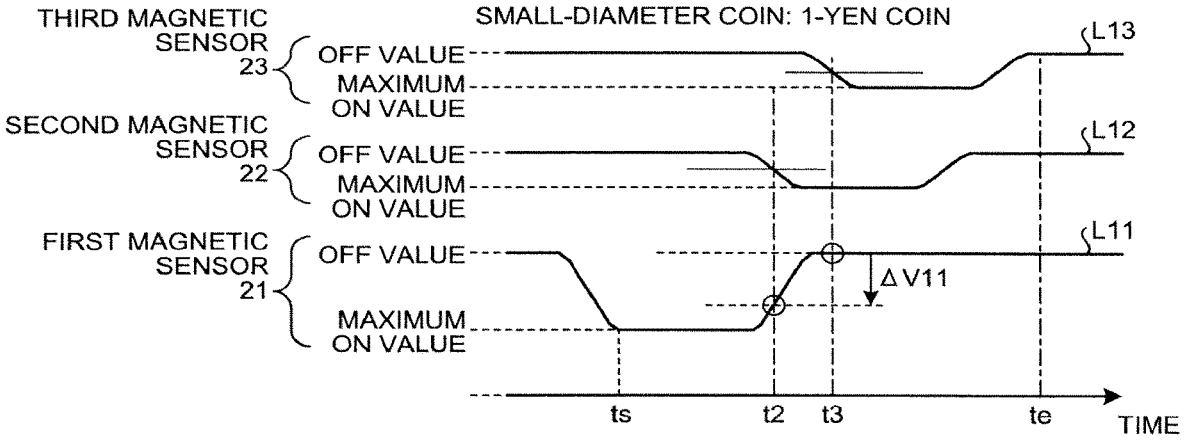
FIG. 9 is a timing chart illustrating a specific example of a coin identification performed on a 1-yen coin as a small-diameter coin.

As illustrated in FIG. 9, in the case of a 1-yen coin, the second magnetic sensor 22 detects the arc of the 1-yen coin at a timing t2 and switches to the ON state. Herein, the threshold value for determination of switching to the ON state is set to a value obtained when the highest ON value changes by 50% of the highest ON value with respect to the smallest coin from among the target coins for identification. In the case of a 1-yen coin, since the outer diameter is small, the first magnetic sensor 21 has detected the arc at the timing t2, and a magnetic variation amount ΔV11 from the OFF value represents the amount of magnetic variation with respect to the outer diameter of the 1-yen coin. In the case of the 1-yen coin, at the point of time at which the third magnetic sensor 23 switches to the ON state at a timing t3, the first magnetic sensor 21 has already switched to the OFF state because of the small diameter. Hence, based on the magnetic variation amount ΔV11, it can be determined that the outer diameter is of a 1-yen coin.

Figure 10:
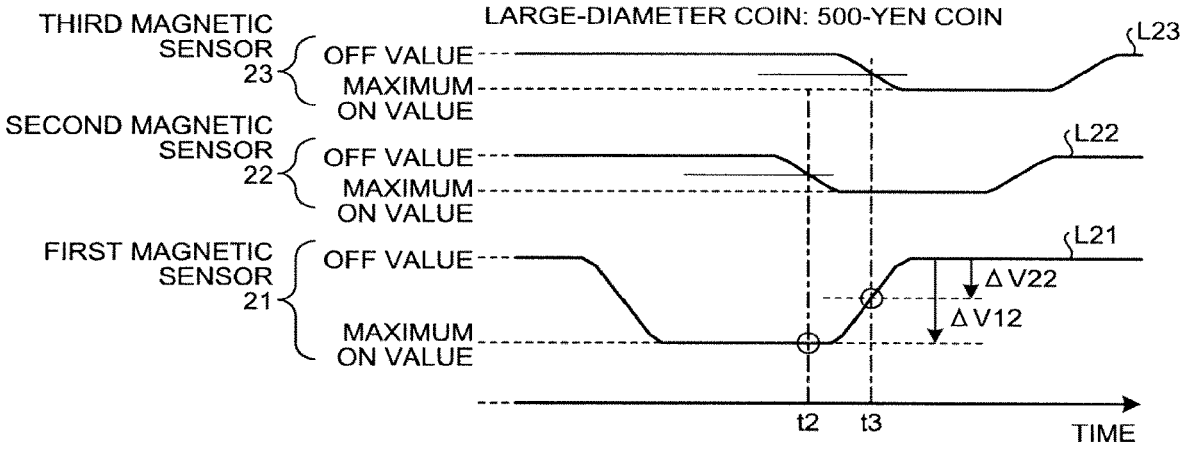
FIG. 10 is a timing chart illustrating a specific example of the coin identification performed on a 500-yen coin as the large-diameter coin.

As illustrated in FIG. 10, in the case of a 500-yen coin, because of a large outer diameter, when the second magnetic sensor 22 detects the arc of the 500-yen coin at the timing t2, the first magnetic sensor 21 is not detecting the arc because of being in the state of detecting the entire 500-yen coin (a magnetic variation amount ΔV12). Subsequently, when the third magnetic sensor 23 switches to the ON state and detects the arc of the 500-yen coin at the timing t3, the first magnetic sensor 21 is detecting the arc of the 500-yen coin. Based on a magnetic variation amount ΔV22 of the first magnetic sensor 21 at the timing t3, it can be determined that the outer diameter is of a 500-yen coin.

Figure 11:
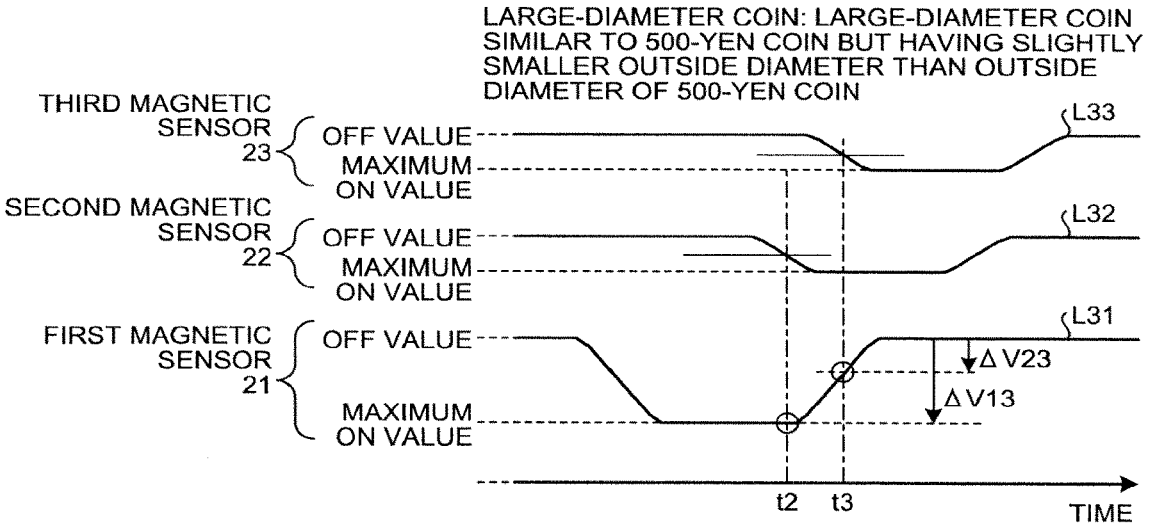
FIG. 11 is a timing chart illustrating a specific example of the coin identification performed on a coin similar to the 500-yen coin.

As illustrated in FIG. 11, in the case of a large-diameter coin that is similar to a 500-yen coin but that has a slightly smaller outer diameter than the outer diameter of the 500-yen coin, the detection is done in a manner identical to the detection of a 500-yen coin. However, a magnetic variation amount ΔV23, which corresponds to the magnetic amount variation ΔV22, becomes smaller. Based on the magnetic variation amount ΔV23, it can be determined that the outer diameter is of a large-diameter coin similar to a 500-yen coin.

Figure 12:
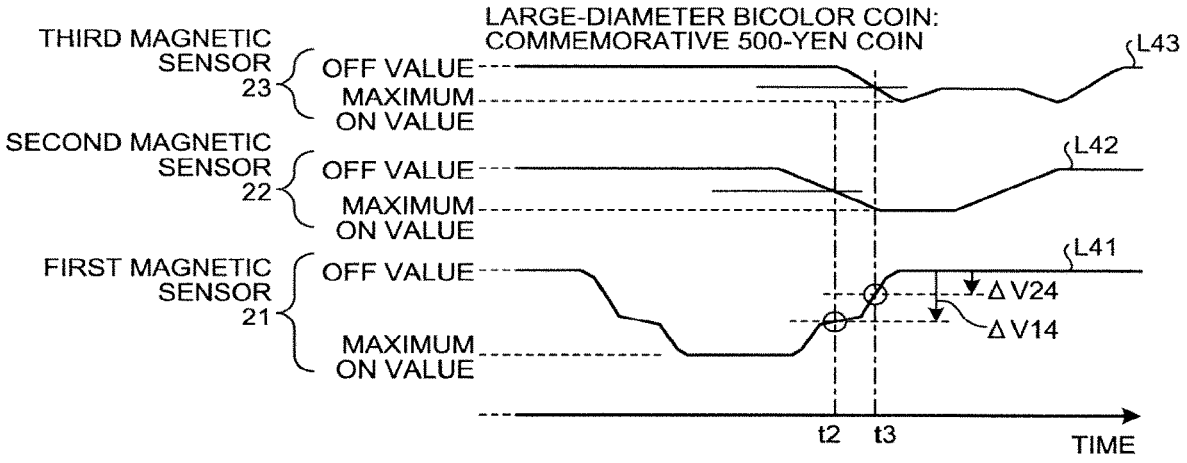
FIG. 12 is a timing chart illustrating a specific example of the coin identification performed on a large-diameter bicolor coin.

As illustrated in FIG. 12, in the case of a commemorative 500-yen coin that is a large-diameter bicolor coin, in a manner identical to the case of a 500-yen coin, based on the value of a magnetic variation amount ΔV24 of the first magnetic sensor 21 at the time when the third magnetic sensor 23 switches to the ON state at the timing t3, it can be determined that the outer diameter is of a commemorative 500-yen coin. If the distance between the second magnetic sensor 22 and the third magnetic sensor 23 is set to be equal to the width d2 of the outer ring portion 31, based on a magnetic variation amount ΔV14 of the first magnetic sensor 21 at the time when the second magnetic sensor 22 switches to the ON state at the timing t2, it becomes possible to determine the diameter of the core portion 32. The result of that determination represents one of the factors for discriminating the denomination of bicolor coins.

Identification Control Operation

Figure 13:
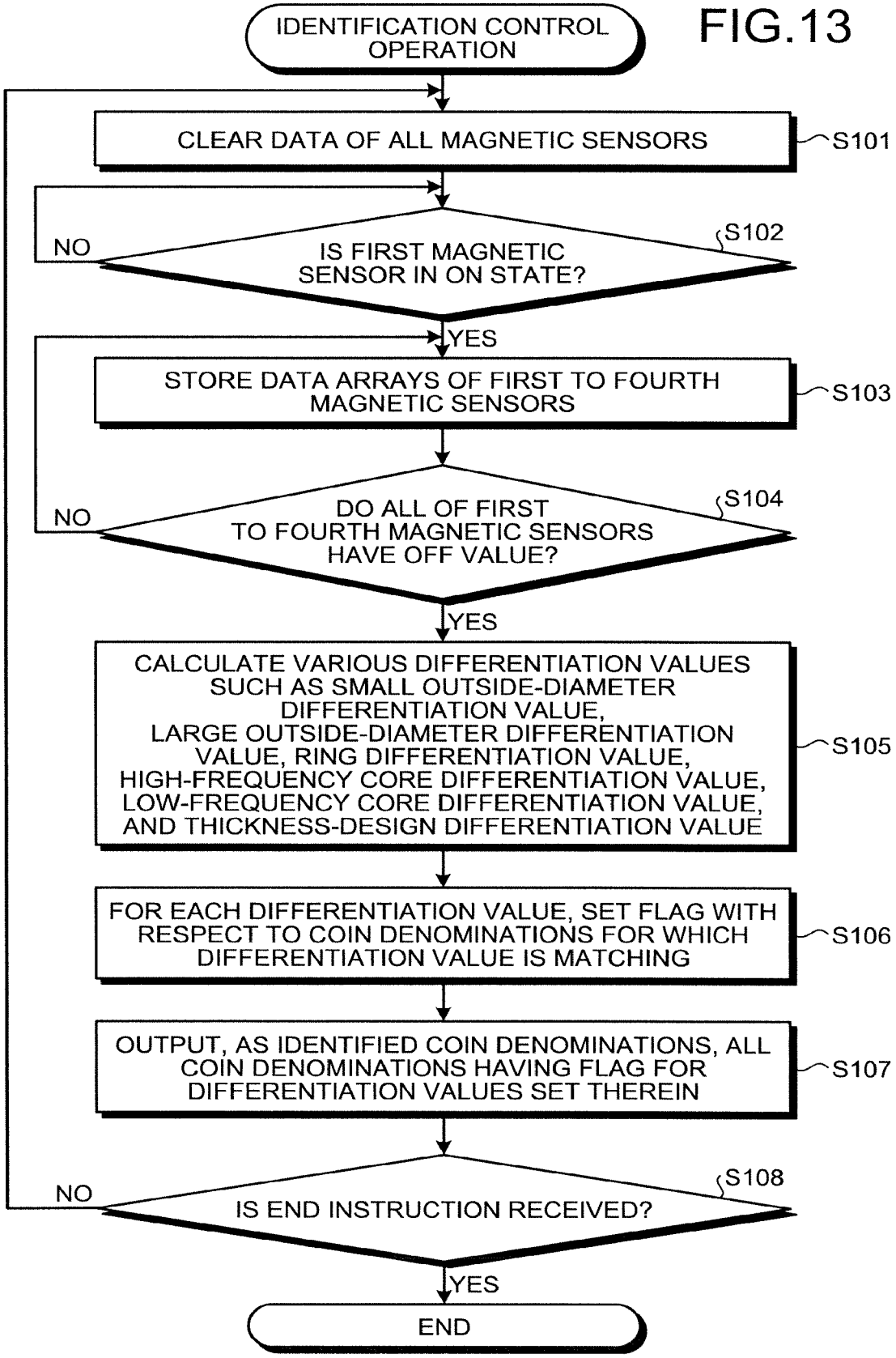
FIG. 13 is a flowchart illustrating a of an identification control operation performed by an identification control unit.

Explained below with reference to FIG. 13 is a sequence of operations in an identification control operation performed by the identification control unit 14. As illustrated in FIG. 13, firstly, the identification control unit 14 clears the data that are temporarily stored in the first magnetic sensor 21 to the fourth magnetic sensor 24 (Step S101). Then, the identification control unit 14 determines whether the first magnetic sensor 21 has switched to the ON state (Step S102). Herein, in a manner identical to the case of the second magnetic sensor 22 and the third magnetic sensor 23, it can be detected that the first magnetic sensor 21 has switched to the ON state either when the highest ON value changes by 50% of the highest ON value with respect to the smallest coin from among the target coins for identification, or at a timing is at which the highest ON value is obtained as illustrated in FIG. 9. If the first magnetic sensor 21 has switched to the ON state (Yes in Step S102), then the identification control unit 14 starts storing data arrays of the first magnetic sensor 21 to the fourth magnetic sensor 24 in the memory unit 15 (Step S103). However, if the first magnetic sensor 21 has not switched to the ON state (No in Step S102), the identification control unit 14 again performs the determination operation in Step S102.

Subsequently, the identification control unit 14 determines whether all of the first magnetic sensor 21 to the fourth magnetic sensor 24 have the OFF value (Step S104). If all of the first magnetic sensor 21 to the fourth magnetic sensor 24 do not have the OFF value (No in Step S104), then the system control returns to Step S103 and the identification control unit 14 continues storing the data arrays.

When all of the first magnetic sensor 21 to the fourth magnetic sensor 24 have the OFF value (Yes in Step S104), the identification control unit 14 calculates various discrimination values such as a small outer diameter discrimination value, a large outer diameter discrimination value, a ring discrimination value, a high-frequency core discrimination value, a low-frequency core discrimination value, and a thickness-design discrimination value (Step S105).

The small outer diameter discrimination value represents the amount of magnetic variation that is detected by the first magnetic sensor 21 when the second magnetic sensor 22 detects the arc of a coin. For example, the magnetic variation amount ΔV11 illustrated in FIG. 9 represents the small outer diameter discrimination value. The large outer diameter discrimination value represents the amount of magnetic variation that is detected by the first magnetic sensor 21 when the third magnetic sensor 23 detects the arc of a coin. For example, the magnetic variation amount ΔV22 illustrated in FIG. 10 represents the small outer diameter discrimination value.

Figure 14:
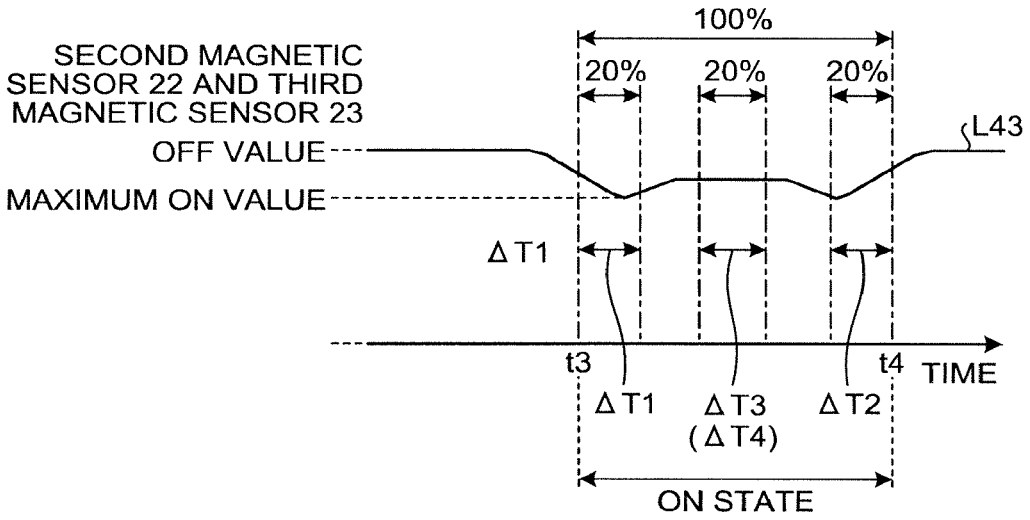
FIG. 14 is a diagram illustrating data obtaining positions serving as the bases of a ring discrimination value, a high-frequency core discrimination value, and a low-frequency core discrimination value.

As illustrated in FIG. 14, the ring discrimination value represents the average value of the detection data that, from among the detection data during the ON state starting from the detection of the arc of a coin by the second magnetic sensor 22 or the third magnetic sensor 23 up to the non-detection of that arc, is taken by averaging the detection data during a time period ΔT1 representing the first 20% of the time period and the detection data during a time period ΔT2 representing the last 20% of the time period. As illustrated in FIG. 14, the high-frequency core discrimination value represents the average value of the detection data during a time period ΔT3 representing the middle 20% of the time period from among the detection data during the ON state of the second magnetic sensor 22 excitable in high frequency or the third magnetic sensor 23. In a manner identical to the high-frequency core discrimination value, the low-frequency core discrimination value represents the average value of the detection data during a time period ΔT4 representing the middle 20% of the time period from among the detection data during the ON state of the third magnetic sensor 23 excitable in low frequency or the second magnetic sensor 22. The thickness-design discrimination value represents pattern data detected by the fourth magnetic sensor 24.

For each calculated discrimination value such as the small outer diameter discrimination value, the large outer diameter discrimination value, the ring discrimination value, the high-frequency core discrimination value, the low-frequency core discrimination value, and the thickness-design discrimination value; the identification control unit 14 sets a flag with respect to the coin denominations for which the discrimination value is matching (Step S106). With that, the coin denominations for which the flag is set become the candidates for identified coin denomination. Then, the identification control unit 14 outputs all coin denominations having the flag for discrimination values set therein as identified coin denominations (Step S107). Then, the identification control unit 14 determines whether or not an end instruction for ending the operations is received (Step S108). If an end instruction is not received (No in Step S108), then the system control returns to Step S101 and the identification control unit 14 repeatedly performs the operations. When an end instruction is received (Yes in Step S108), the identification control unit 14 ends the operations.

Meanwhile, if a 500-yen coin and a commemorative 500-yen coin, which is a large-diameter bicolor coin, have the same outer diameter, the commemorative 500-yen coin can be discriminated by comparing the variation thereof at the of time rising and falling of ON/OFF of the second magnetic sensor 22 excitable in high frequency and the variation thereof at the of time rising and falling of ON/OFF of the third magnetic sensor 23 excitable in low frequency with the variation of the 500-yen coin.

Figure 15:
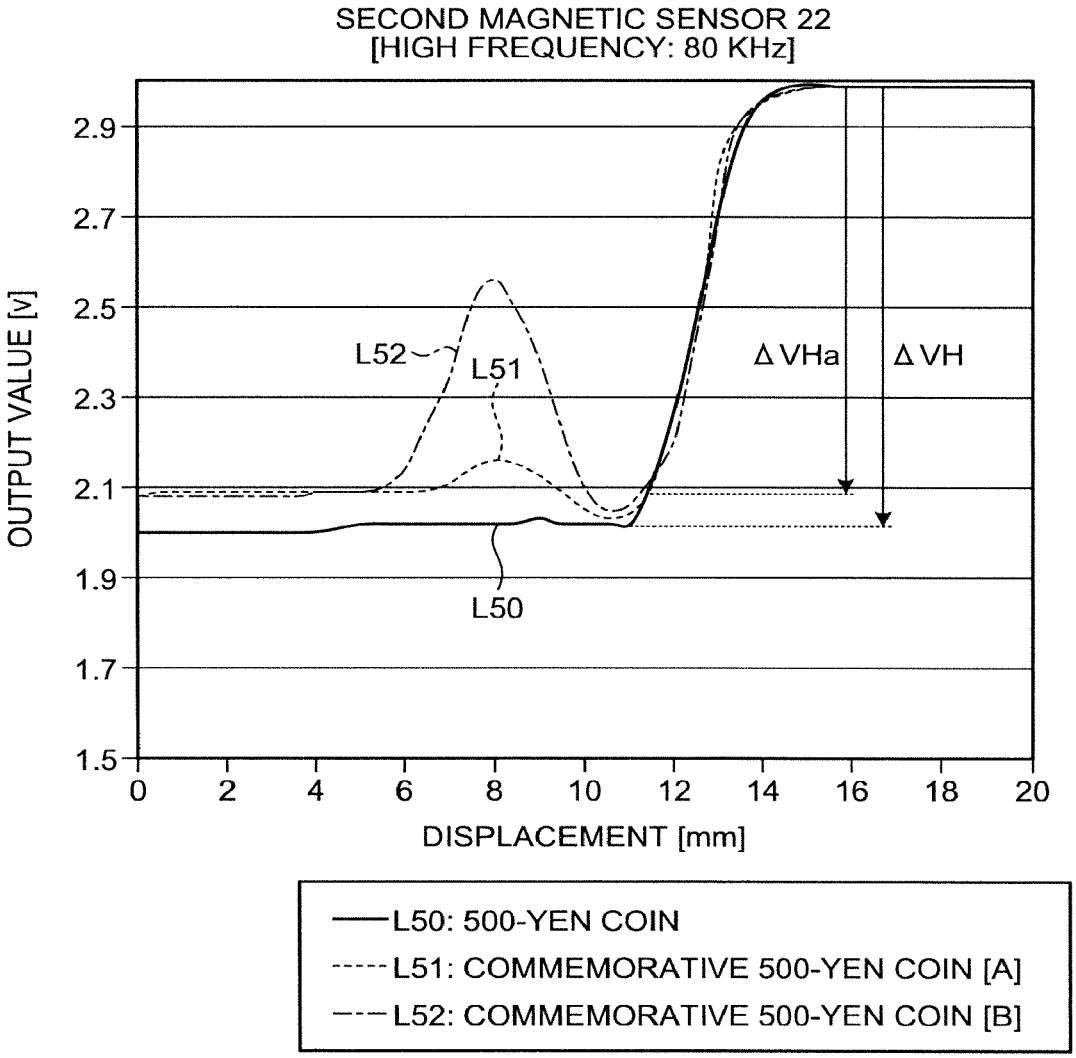
FIG. 15 is a diagram illustrating a rising change in an OFF-state of the second magnetic sensor, excited in high-frequency, with respect to a 500-yen coin, a commemorative 500-yen coin (A), and a commemorative 500-yen coin (B)
Figure 16:
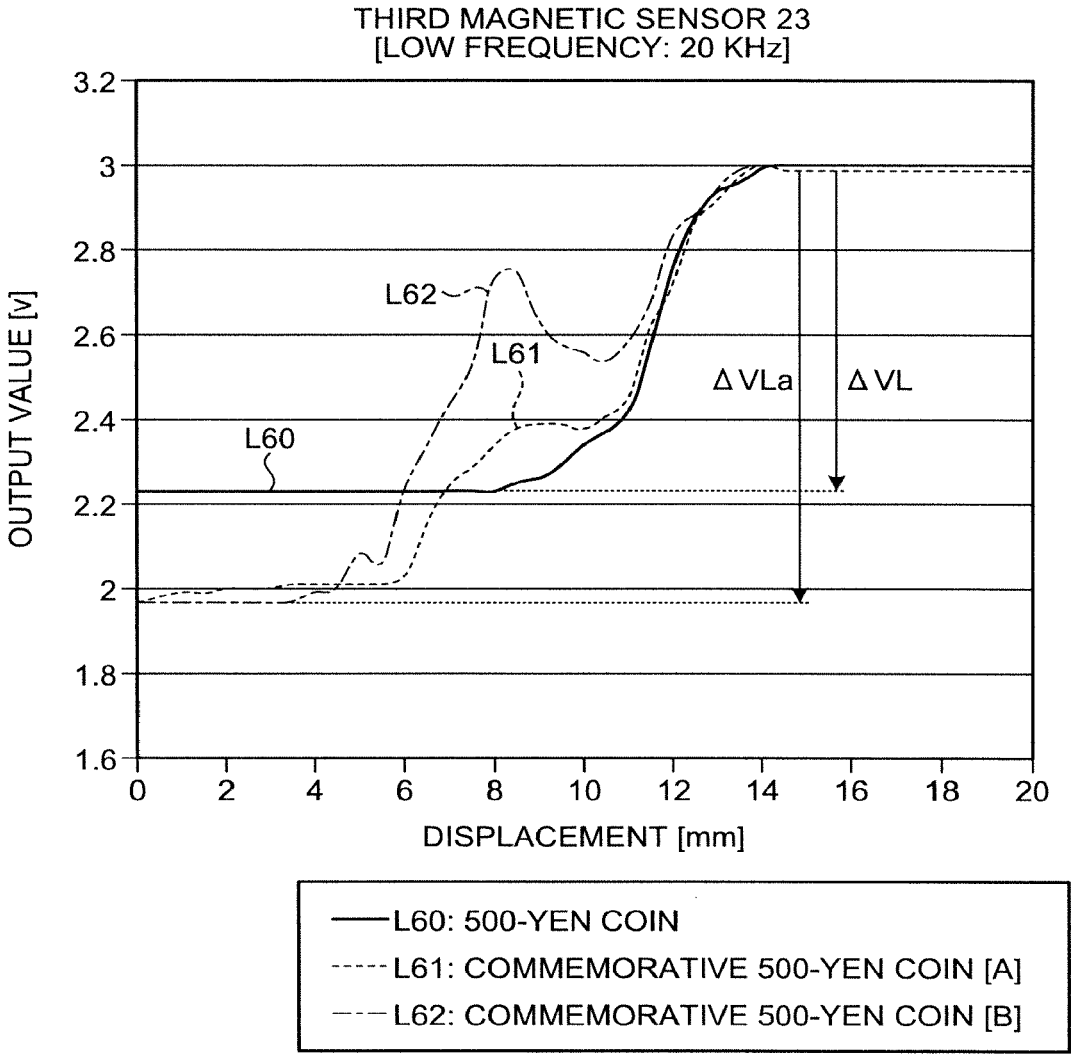
FIG. 16 is a diagram illustrating rising change in an OFF-state of the third magnetic sensor, excited in low-frequency, with respect to the 500-yen coin, the commemorative 500-yen coin (A), and the commemorative 500-yen coin (B)

FIG. 15 is a diagram illustrating the variation in the OFF-state rising of the second magnetic sensor 22, excited in high-frequency, with respect to a 500-yen coin, a commemorative 500-yen coin (A), and a commemorative 500-yen coin (B). FIG. 16 is a diagram illustrating the variation in the OFF-state rising of the third magnetic sensor 23, excited in low-frequency, with respect to the 500-yen coin, the commemorative 500-yen coin (A), and the commemorative 500-yen coin (B). In FIGS. 15 and 16, the horizontal axis represents the displacement of the center of the coin with respect to the center of the magnetic sensor. As illustrated in FIG. 15, in the OFF state of the second magnetic sensor 22 excitable in high-frequency, a variation amount ΔVHa of rising of the commemorative 500-yen coin (A) and the commemorative 500-yen coin (B) is smaller than a variation amount ΔVH of the 500-yen coin. On the other hand, as illustrated in FIG. 16, in the OFF state of the third magnetic sensor 23 excitable in low frequency, a variation amount ΔVLa of rising of the commemorative 500-yen coin (A) and the commemorative 500-yen coin (B) is greater than a variation amount ΔVL of the 500-yen coin. Using such relationship, it becomes possible to discriminate a 500-yen coin from a commemorative 500-yen coin having the same outer diameter.

Meanwhile, the variation in rising of the commemorative 500-yen coin (A) is different from the variation in rising of the commemorative 500-yen coin (B) at displacements 6 to 11. That is because, at the time of manufacturing bicolor coins, differences occur in the joint (differences occur in the impedance) between the outer ring portion and the core portion.

In the first embodiment, the first magnetic sensor 21, the second magnetic sensor 22, and the third magnetic sensor 23 are arranged in this order in the carrying direction A. Alternatively, the arrangement may be made in an order of the third magnetic sensor 23, the second magnetic sensor 22, and the first magnetic sensor 21. That is, the second magnetic sensor 22 and the third magnetic sensor 23 may be arranged on the upstream side of the first magnetic sensor 21. If the third magnetic sensor 23, the second magnetic sensor 22, and the first magnetic sensor 21 are arranged in this order in the carrying direction A; then the third magnetic sensor 23 and the second magnetic sensor 22 calculate the large outer diameter discrimination value and the small outer diameter discrimination value based on the amount of magnetic variation of the first magnetic sensor 21 when the arc at the rear end of a coin is detected, that is, at the point of time when the maximum ON value changes to the OFF value.

In the first embodiment, the small outer diameter discrimination value is calculated based on the amount of magnetic variation of the first magnetic sensor 21 when the second magnetic sensor 22 detects the arc of a coin. Similarly, the large outer diameter discrimination value is calculated based on the amount of magnetic variation of the first magnetic sensor 21 when the third magnetic sensor 23 detects the arc of a coin. In this case, the first magnetic sensor 21 is detecting the amount of magnetic variation in the state where the arc of the coin is detectible. That amount of magnetic variation corresponds to the distance between the arcs on the upstream side and the downstream side of the coin, that is, corresponds to the diameter of the coin. As a result, the accuracy of coin identification is dependent on the accuracy of arrangement of the first magnetic sensor 21, the second magnetic sensor 22, and the third magnetic sensor 23 in the carrying direction A (the center line L1). Thus, even if the coin undergoes a position variation in the width direction, which is perpendicular to the carrying direction A, with respect to the center line L1; there is no considerable impact on the accuracy of coin identification.

In addition, since the accuracy of coin identification is dependent on the amount of magnetic variation of the first magnetic sensor 21; the first magnetic sensor 21 is formed in an elliptical shape and is placed to have the long axis thereof running along the carrying direction, thereby enabling achieving reduction in the size of the coin identification unit 10 in the width direction. Moreover, the second magnetic sensor 22 and the third magnetic sensor 23 are arranged either on the upstream side or on the downstream side of the first magnetic sensor 21 and, in the detection in the direction of the long axis of the first magnetic sensor 21, the same detection area is used also to enable detection of the amount of magnetic variation with respect to small-diameter coins and large-diameter coins. Hence, the size of the coin identification unit 10 in the carrying direction A can also be reduced.

Second Embodiment

Configuration of Coin Identification Unit

Figure 17:
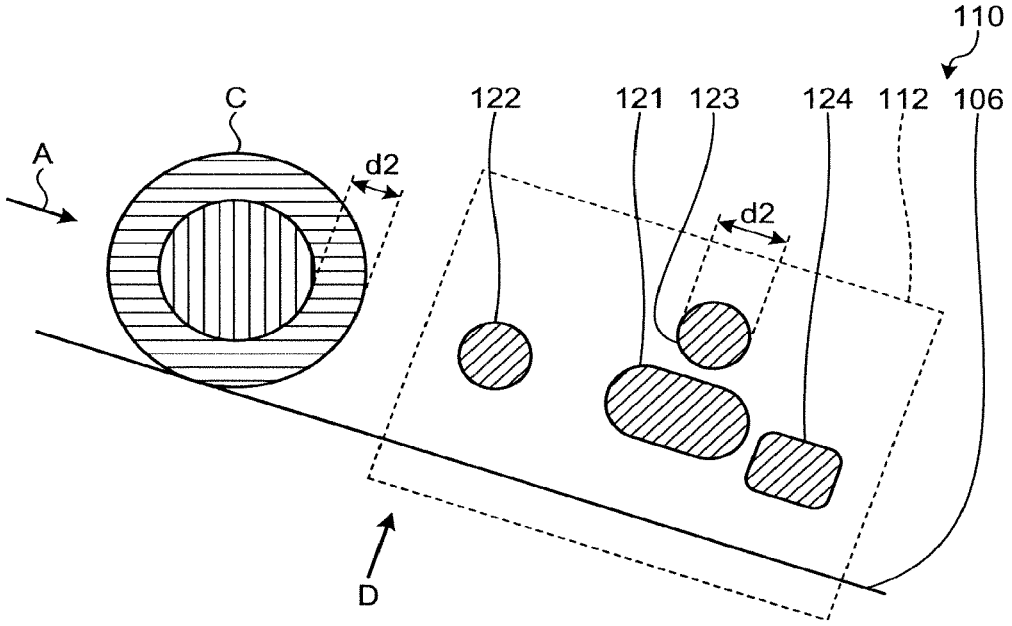
FIG. 17 is a schematic diagram illustrating a configuration of a coin identification unit according to a second embodiment of the present disclosure.
Figure 18:
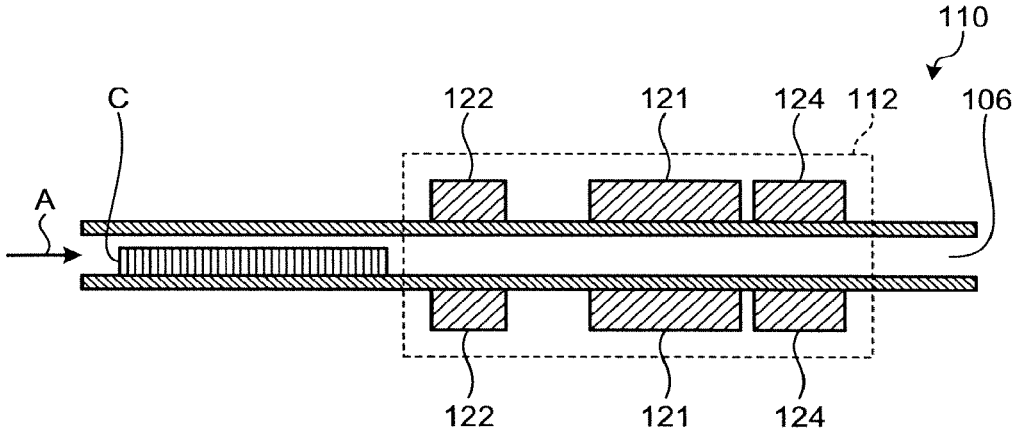
FIG. 18 is a D-arrow perspective view of the coin identification unit of FIG. 17.

FIG. 17 is a schematic diagram illustrating a configuration of a coin identification unit 110 according to a second embodiment of the present invention. FIG. 18 is a D-arrow perspective view of the coin identification unit 110 of FIG. 17. In the coin identification unit 110, a sensor unit 112 that corresponds to the sensor unit 12 of the coin identification unit 10 includes a first magnetic sensor 121, a second magnetic sensor 122, a third magnetic sensor 123, and a fourth magnetic sensor 124 that correspond to the first magnetic sensor 21, the second magnetic sensor 22, the third magnetic sensor 23, and the fourth magnetic sensor 24.

In an identical manner to the first magnetic sensor 21, in the first magnetic sensor 121, coils are wound in an elliptical shape with the carrying direction A for carrying the coin C representing the direction of the long axis, and the maximum diameter of the coils is smaller than the maximum diameter of coins. The first magnetic sensor 121 continuously detects the amount of magnetic variation accompanying the passage of the coin C along the carrying direction A. The second magnetic sensor 122 is installed on the upstream side of the first magnetic sensor 121, and has the center thereof placed on the long axis of the first magnetic sensor 121. The third magnetic sensor 123 is installed in the width direction with respect to the position of the first magnetic sensor 121 and is placed at a position at which, when the coin C passes along a carrying pathway 106, a small-diameter coin is not detected and only a large-diameter coin can be detected. The fourth magnetic sensor 124 has a configuration identical to the configuration of the fourth magnetic sensor 24 and is installed on the downstream side of the first magnetic sensor 121.

Figure 19:
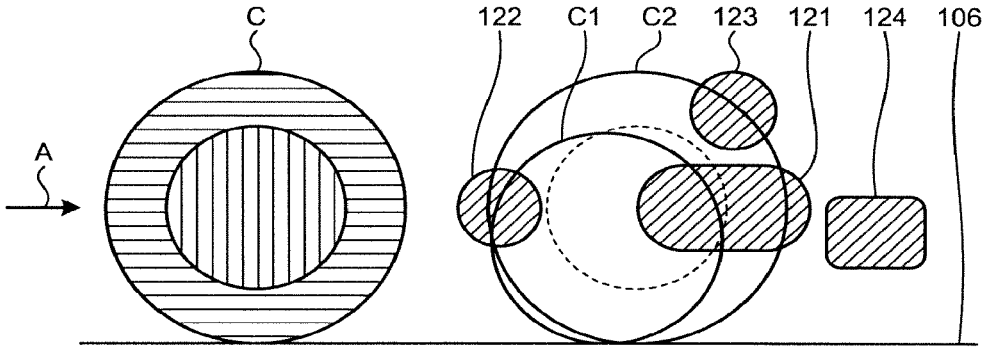
FIG. 19 is a diagram illustrating the relative positional relationships between first to fourth magnetic sensors according to the second embodiment and a small-diameter coin and a large-diameter coin.

As illustrated in FIG. 19, the first magnetic sensor 121 is installed at a position at which, when the second magnetic sensor 122 detects the downstream-side arc of a small-diameter coin C1, the upstream-side arc of the small-diameter coin C1 can be detected at the center of the long axis (the portion having equal widths in the oval shape). The third magnetic sensor 123 is installed at a position at which, when the downstream-side arc of a large-diameter coin C2 is detected, the first magnetic sensor 121 can detect the upstream-side arc of the large-diameter coin C2. Meanwhile, it is desirable that the coil diameter of the third magnetic sensor 123 be equal to or smaller than the width of the outer ring portion of a large-diameter bicolor coin.

Specific Example of Coin Identification

Figure 20:
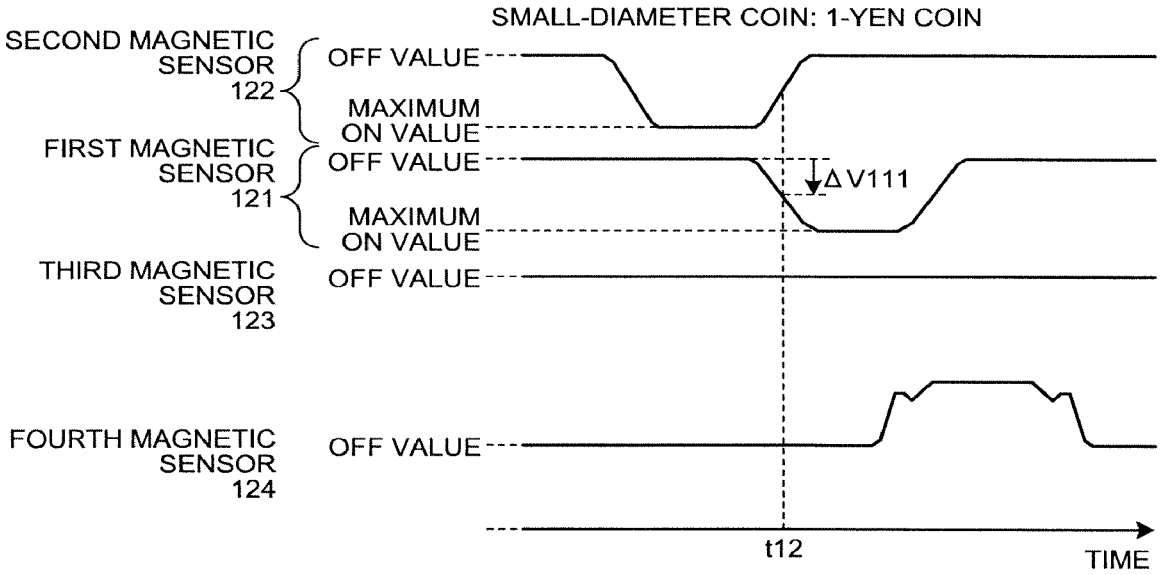
FIG. 20 is a timing chart illustrating a specific example of the coin identification performed on a 1-yen coin as a small-diameter coin.
Figure 21:
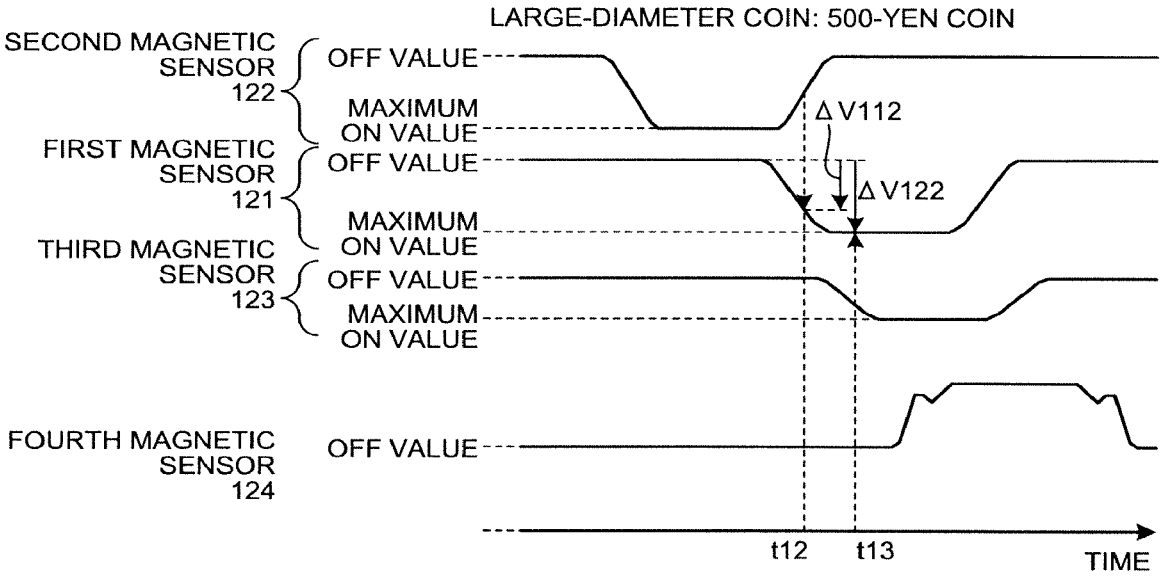
FIG. 21 is a timing chart illustrating a specific example of the coin identification performed on a 500-yen coin as the large-diameter coin.
Figure 22:
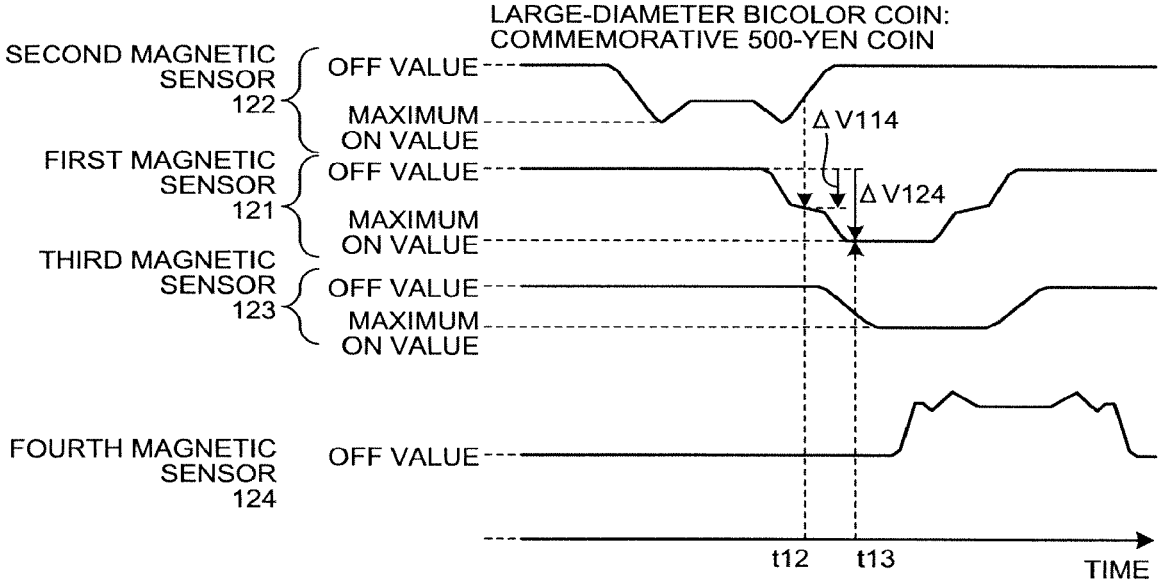
FIG. 22 is a timing chart illustrating a specific example of the coin identification performed on a commemorative 500-yen coin as the large-diameter bicolor coin.

FIGS. 20 to 22 are timing charts illustrating specific examples of the coin identification performed on a 1-yen coin representing a small-diameter coin, a 500-yen coin representing a large-diameter coin, and a commemorative 500-yen coin representing a large-diameter bicolor coin.

As illustrated in FIG. 20, in the case of a 1-yen coin, the second magnetic sensor 122 detects the arc of the 1-yen coin at a timing t12 and switches to the ON state. In the case of the 1-yen coin, since the outer diameter is small, the third magnetic sensor 123 does not switch to the ON state thereafter; and the first magnetic sensor 121 at the timing t12 has detected the arc, and a magnetic variation amount ΔV111 from the OFF value of the first magnetic sensor 121 represents the amount of magnetic variation with respect to the outer diameter of the 1-yen coin.

As illustrated in FIG. 21, in the case of a 500-yen coin, based on a magnetic variation amount ΔV112 of the first magnetic sensor 121 when the second magnetic sensor 122 detects the arc of the 500-yen coin at the timing t12 and based on a magnetic variation amount ΔV122 of the first magnetic sensor 121 when the third magnetic sensor 123 detects the arc of the 500-yen coin at a timing t13, the coin is discriminated to be a 500-yen coin. That is, from the fact that the magnetic variation amount ΔV122 is the maximum ON value, the coin is discriminated to be a large-diameter coin; and, from the magnetic variation amount ΔV122 of the large-diameter coin, the coin is discriminated to be a 500-yen coin.

As illustrated in FIG. 22, in the case of a commemorative 500-yen coin representing a large-diameter bicolor coin, based on a magnetic variation amount ΔV114 of the first magnetic sensor 121 when the second magnetic sensor 122 detects the arc of the commemorative 500-yen coin at the timing t12 and based on a magnetic variation amount ΔV124 of the first magnetic sensor 121 when the third magnetic sensor 123 detects the arc at the timing t13, the coin is discriminated to be a commemorative 500-yen coin. That is, from the fact that the magnetic variation amount ΔV124 is the maximum ON value, the coin is discriminated to be a large-diameter coin; and, from the magnetic variation amount ΔV114 of the large-diameter coin, the coin is discriminated to be a commemorative 500-yen coin.

Meanwhile, unlike in the first embodiment, the coin C that is carried in the coin identification unit 110 according to the second embodiment rolls on the carrying pathway 106 that is placed in a tilted manner. Thus, depending on the difference in the outer diameter, the center of the coin C differs in the width direction that is orthogonal to the carrying direction A. That is, in the second embodiment, unlike in the first embodiment, the center of a coin varies in the width direction depending on the difference in the outer diameter of the coin. In that regard, in the second embodiment, since small-diameter coins and large-diameter coins are discriminated from each other, it becomes possible to prevent reduction in the discrimination accuracy. That is, whether a coin is a small-diameter coin or a large-diameter coin is discriminated depending on whether the third magnetic sensor 123 detects the arc of the coin; and the outer diameter of the coin is discriminated depending on the amount of magnetic variation detected by the first magnetic sensor 121.

According to the present invention, in a coin identification device, a first magnetic sensor has coils wound in an elliptical shape with the carrying direction for carrying coins representing the direction of the long axis, and the maximum diameter of the coils is smaller than the maximum diameter of coins; and continuously detects the amount of magnetic variation while a coin passes along the carrying direction. A second magnetic sensor is installed in the direction of the long axis and is installed at a position at which, when the first magnetic sensor is detecting the passage of a small-diameter coin having the diameter equal to or smaller than a predetermined diameter, the passage of the arc of that small-diameter coin is detected. A third magnetic sensor is installed at a position at which, when the first magnetic sensor and the second magnetic sensor are detecting the passage of a small-diameter coin having the diameter equal to or smaller than a predetermined diameter, the passage of the arc of the small-diameter coin is not detected; but the passage of the arc of a large-diameter coin having the diameter exceeding the predetermined diameter is detected. Based on the amount of magnetic variation of the first magnetic sensor with reference to the passage of the arc of the coin at the second magnetic sensor and the third magnetic sensor, small-diameter coins and large-diameter coins are discriminated. Hence, downsizing of the device can be achieved while allowing position variation of coins in the direction perpendicular to the carrying direction of the coins.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin identification device that identifies denomination of a coin inserted therein, comprising:

a first magnetic sensor that includes a coil which is wound in an elliptical shape in a manner that a long axis of the coil extends in a carrying direction of the coin wherein a maximum diameter of the coil is smaller than a maximum diameter of the coin, and that is configured to continuously detect an amount of magnetic variation while the coin passes in the carrying direction;

a second magnetic sensor that is installed in the direction of the long axis and at a position where the second magnetic sensor detects a passage of an arc of a small-diameter coin when the first magnetic sensor is detecting a passage of the small-diameter coin having a diameter equal to or smaller than a predetermined diameter; and a third magnetic sensor that is installed at a position where the third magnetic sensor does not detect a passage of an arc of the small-diameter coin having the diameter equal to or smaller than the predetermined diameter when the first magnetic sensor and the second magnetic sensor are detecting a passage of the small-diameter coin and the third magnetic sensor detects a passage of an arc of a large-diameter coin having a diameter exceeding the predetermined diameter; and an identification control unit configured to:

identify an outer diameter of the small-diameter coin based on the amount of magnetic variation of the first magnetic sensor when the first magnetic sensor detects the coin, the second magnetic sensor detects a passage of an arc of the coin, and the third magnetic sensor does not detect a passage of an arc of the coin, and further identify an outer diameter of the large-diameter coin based on the amount of the magnetic variation of the first magnetic sensor when the first magnetic sensor and the second magnetic sensor detect the coin and the third magnetic sensor detects a passage of an arc of the coin.

2. The coin identification device according to claim 1, wherein the second magnetic sensor is installed at a position where the second magnetic sensor detects an arc on an opposite side with respect to the carrying direction of the coin when an arc of the small-diameter coin is detected in a middle of a direction of the long axis of the first magnetic sensor, and the third magnetic sensor is installed in the direction of the long axis and at a position where the third magnetic sensor detects an arc on an opposite side with respect to the carrying direction of the large-diameter coin when an arc of the large-diameter coin is detected in a middle of the direction of the long axis of the first magnetic sensor.

3. The coin detection device according to claim 2, wherein the coin includes a bicolor coin having an outer ring portion and a core portion having a disk-shape and which is embedded in a hollow area of the outer ring portion, a length of the first magnetic sensor in the direction of the long axis corresponds to a diameter of the core portion of the bicolor coin, and a distance between the second magnetic sensor and the third magnetic sensor in the carrying direction corresponds to a width of the outer ring portion of the bicolor coin.

4. The coin identification device according to claim 3, wherein the identification control unit is configured to, based on an amount of magnetic variation of the coin passing the second magnetic sensor or the third magnetic sensor, detect a difference in material between the outer ring portion and the core portion and identify the bicolor coin.

5. The coin identification device according to claim 4, wherein the identification control unit is configured to, based on a change in a magnetic detection waveform of the coin passing the second magnetic sensor or the third magnetic sensor, identify the bicolor coin.

6. The coin identification device according to claim 2, wherein each of the second magnetic sensor and the third magnetic sensor has a coil which is wound in an elliptical shape having the direction of the long axis orthogonal to the carrying direction of the coin.

7. The coin identification device according to claim 2, wherein the identification control unit is configured to identify the outer diameter of the small-diameter coin based on the amount of the magnetic variation of the first magnetic sensor when the second magnetic sensor detects a passage of an arc of the coin, and further identify the outer diameter of the large-diameter coin based on the amount of the magnetic variation of the first magnetic sensor when the third magnetic sensor detects a passage of an arc of the coin.

8. The coin identification device according to claim 2, wherein the coin includes a clad coin in which a material of a surface layer and a material of a middle layer are different from each other, one of the second magnetic sensor and the third magnetic sensor is a low-frequency excitation sensor that detects the material of the middle layer of the clad coin, the other of the second magnetic sensor and the third magnetic sensor is a high-frequency excitation sensor that detects the material of the surface layer of the clad coin, and the identification control unit is configured to identify the clad coin based on detection results of the low-frequency excitation sensor and the high-frequency excitation sensor.

9. The coin identification device according to claim 2, wherein the long axis of the first magnetic sensor, a center of the second magnetic sensor, and a center of the third magnetic sensor are aligned along an axis parallel to the carrying direction of the coin.

10. The coin identification device according to claim 9, further comprising:

a center-positioning and carrying mechanism configured to regulate a movement of the coin in a manner that a center of the coin moves along a center line of a carrying pathway when the coin is provided on the carrying pathway.

11. The coin identification device according to claim 2, further comprising:

a fourth magnetic sensor that is installed in between the first magnetic sensor and the second magnetic sensor and that is configured to detect a surface asperity of the coin.

12. The coin identification device according to claim 1, wherein the second magnetic sensor is installed at a position where, when the second magnetic sensor detects the arc of the small-diameter coin, the first magnetic sensor detects an arc on an opposite side with respect to the carrying direction of the small-diameter coin, and the third magnetic sensor is installed at a position where the third magnetic sensor detects the arc of the large-diameter coin, the first magnetic sensor detects the large-diameter coin.

13. The coin identification device according to claim 1, wherein the coin includes a bicolor coin having an outer ring portion and a core portion having a disk shape and that is embedded in a hollow area of the outer ring portion, and a coil diameter of the third magnetic sensor is equal to or smaller than a width of the outer ring portion of the bicolor coin having a large diameter, and the identification control unit is configured to detect a difference in material between the outer ring portion and material of the core portion and identify the bicolor coin based on an amount of the magnetic variation detected by the first magnetic sensor or the second magnetic sensor and an amount of the magnetic variation detected by the third magnetic sensor.

14. The coin identification device according to claim 10, further comprising:

a carrier belt to carry the coin along the carrying pathway when the coin is provided on the carrying pathway, wherein the center-positioning and carrying mechanism has a tapered shape with a center which is aligned with the center line of the carrying pathway.

15. The coin identification device according to claim 1, further comprising:

a carrying pathway on which the coin is to move along in the carrying direction, wherein the second magnetic sensor is installed between the first magnetic sensor and the third magnetic sensor with respect to the carrying direction, and a center of each of the first magnetic sensor, the second magnetic sensor, and the third magnetic sensor is aligned with a center line of the carrying pathway and with a center of the coin when the coin is provided on the carrying pathway.

16. The coin identification device according to claim 15, further comprising a fourth magnetic sensor that is installed between the first magnetic sensor and the second magnetic sensor and that is configured to detect a surface asperity of the coin, wherein a center of the fourth magnetic sensor is aligned with the center line of the carrying pathway and with the center of the coin when the coin is provided on the carrying pathway.

17. The coin identification device according to claim 1, wherein the predetermined diameter is a length less than a length between a center of the first magnetic sensor and a center of the third magnetic sensor.

18. The coin identification device according to claim 1, further comprising:

a carrying pathway on which the coin is to move along in the carrying direction, wherein the coin is to lay flat when the coin is provided on the carrying pathway, or the coin is to roll along in the carrying direction.

19. A coin identification device that identifies denomination of a coin inserted therein, comprising:

a carrying pathway on which the coin is to roll along in a carrying direction;

a first magnetic sensor that includes a coil which is wound in an elliptical shape in a manner that a long axis of the coil extends in the carrying direction of the coin wherein a maximum diameter of the coil is smaller than a maximum diameter of the coin, and that is configured to continuously detect an amount of magnetic variation while the coin passes in the carrying direction;

a second magnetic sensor that is installed in the direction of the long axis and at a position where the second magnetic sensor detects a passage of an arc of a small-diameter coin when the first magnetic sensor is detecting a passage of the small-diameter coin having a diameter equal to or smaller than a predetermined diameter; and a third magnetic sensor that is installed at a position where the third magnetic sensor does not detect a passage of an arc of the small-diameter coin having the diameter equal to or smaller than the predetermined diameter when the first magnetic sensor and the second magnetic sensor are detecting a passage of the small-diameter coin and the third magnetic sensor detects a passage of an arc of a large-diameter coin having a diameter exceeding the predetermined diameter, the predetermined diameter being a length less than a length which would cause the coin to at least partially overlap both a portion of the first magnetic sensor and a portion of the third magnetic sensor when the coin rolls along in the carrying direction; and an identification control unit configured to:

identify an outer diameter of the small-diameter coin based on the amount of magnetic variation of the first magnetic sensor when the first magnetic sensor detects the coin, the second magnetic sensor detects a passage of an arc of the coin, and the third magnetic sensor does not detect a passage of an arc of the coin, and further identify an outer diameter of the large-diameter coin based on the amount of the magnetic variation of the first magnetic sensor when the first magnetic sensor and the second magnetic sensor detect the coin and the third magnetic sensor detects a passage of an arc of the coin.

20. The coin identification device according to claim 19, wherein the second magnetic sensor is installed upstream of both the first magnetic sensor and the third magnetic sensor with respect to the carrying direction, an imaginary line connecting the center of each of the first magnetic sensor and the second magnetic sensor is parallel to the carrying direction, and the third magnetic sensor is installed at a position above the first magnetic sensor and the second magnetic sensor with respect to the carrying pathway and between opposite ends of the long axis of the coil of the first magnetic sensor.

* * * * *